United States Patent [19]

Dorsett

[11] Patent Number: 5,038,597

[45] Date of Patent: Aug. 13, 1991

[54] BENDING APPARATUS FOR BENDING A MARGINAL FLANGE ON A WORKPIECE

[75] Inventor: Michael W. Dorsett, Weybridge, United Kingdom

[73] Assignee: AB Volvo, Gothenburg, Sweden

[21] Appl. No.: 571,639

[22] PCT Filed: Mar. 7, 1989

[86] PCT No.: PCT/SE89/00106

§ 371 Date: Sep. 6, 1990

§ 102(e) Date: Sep. 6, 1990

[87] PCT Pub. No.: WO89/09102

PCT Pub. Date: Oct. 5, 1989

[30] Foreign Application Priority Data

Mar. 21, 1988 [SE] Sweden ..... 8801034

[51] Int. Cl.[5] ..... B21J 9/18

[52] U.S. Cl. ..... 72/450; 72/314; 72/451; 29/243.58; 100/271; 100/280

[58] Field of Search ..... 72/380, 381, 323, 450, 72/451, 407, 312–315; 29/243.58; 100/280, 271, 281

[56] References Cited

U.S. PATENT DOCUMENTS 4,346,579 8/1982 Takatsu ..... 72/450
4,706,489 11/1987 Dacey, Jr. ..... 72/450

FOREIGN PATENT DOCUMENTS 1445675 6/1966 France .
958672 5/1964 United Kingdom .
958671 5/1965 United Kingdom .

*Primary Examiner*—David Jones
*Attorney, Agent, or Firm*—Young & Thompson

[57] ABSTRACT

Apparatus for bending a margin flange (5), which projects at an angle to a surface on a workpiece (2), against the workpiece. The apparatus includes a bending tool (6) which is mounted on a tool holder (14) carried by a parallelogram mechanism (7–12) for movement in relation to a stand (1) on which the workpiece (2) is placed. A drive arrangement (17) is drivingly connected to the tool holder (14) by a linkage (21–27). The tool holder (14) includes a main part (13) connected to the parallelogram mechanism (7–12) and a movable part (15) which is pivotal about a journal pin (16) on the main part. The journal pin (16) is substantially parallel with the axes (7, 8, 11, 12) of the parallelogram mechanism. The movable part (15) carries the tool (6) and by a resilient element (32) is urged towards a starting position with a nose of the tool (6) biased away from the workpiece (2). The linkage (21–27) includes a projection (28) for co-action with an abutment (29) on the movable part (15) of the tool holder (14) in one position of the linkage (21–27) to cause the movable part (15) of the tool holder (14) to move away from the starting position, the main part (13) of the tool holder (14) thereby being located in the vicinity of an end position in which the tool (6) is in engagement with the margin flange (5) on the workpiece (2).

2 Claims, 2 Drawing Sheets

BENDING APPARATUS FOR BENDING A MARGINAL FLANGE ON A WORKPIECE

The present invention relates to apparatus for bending a margin flange, which projects at an angle to a surface on a workpiece, against said workpiece, the apparatus including a bending tool which is mounted on a tool holder carried by a parallelogram mechanism for movement in relation to a stand on which the workpiece is placed, and further including a drive arrangement which is drivingly connected to the tool holder, by means of a linkage.

Apparatus of this kind are previously known in various forms. Such apparatus are used, for instance, to bend a margin flange on a sheet metal workpiece around the margin of another sheet metal workpiece, to effect a clinching or hemming joint which joins the two workpieces together. This type of operation is common, for instance, within the vehicle manufacturing industry, in the production of different vehicle body parts. One drawback with such known apparatus, however, is that a relatively large free area is required around the margin flange to be bent, in order for the apparatus to function satisfactory. This makes it difficult, or even impossible, to use such apparatus for certain kinds of working operations where said space is extremely limited.

One example of an apparatus of the above mentioned kind is known from GB-A-958671. This previously known apparatus has the drawback that rather large parts of the apparatus are situated both above and below the margin flange to be bent. Therefore, this known apparatus requires a large free space around the margin flange to be bent, and it cannot be used to bend margin flanges in confined spaces.

The object of the invention is to provide apparatus of the aforesaid kind which do not suffer these drawbacks and which can also be used in confined spaces with satisfactory results. This object is achieved in accordance with the invention in that the tool holder includes a main part which is connected to the parallelogram mechanism, and a movable part which is pivotal about a journal pin on the main part, said journal pin being substantially parallel with the journal pins of the parallelogram mechanism; in that the movable part carries the tool and by means of a resilient element is urged towards a starting position with the nose of the tool biased away from the parallelogram mechanism; and in that the linkage is a toggle linkage which includes a projection for co-action with an abutment on the movable part of the tool holder when the toggle linkage is in the proximity of its fully extended state to cause the movable part of the tool holder to move away from the starting position, the main part of the tool holder thereby being located in the vicinity of an end position and the tool being in engagement with the margin flange on the workpiece.

The invention will now be described in more detail with reference to the accompanying drawings, in which FIG. 1 is a somewhat schematic side view of one embodiment of the inventive bending apparatus;

Figure 1:
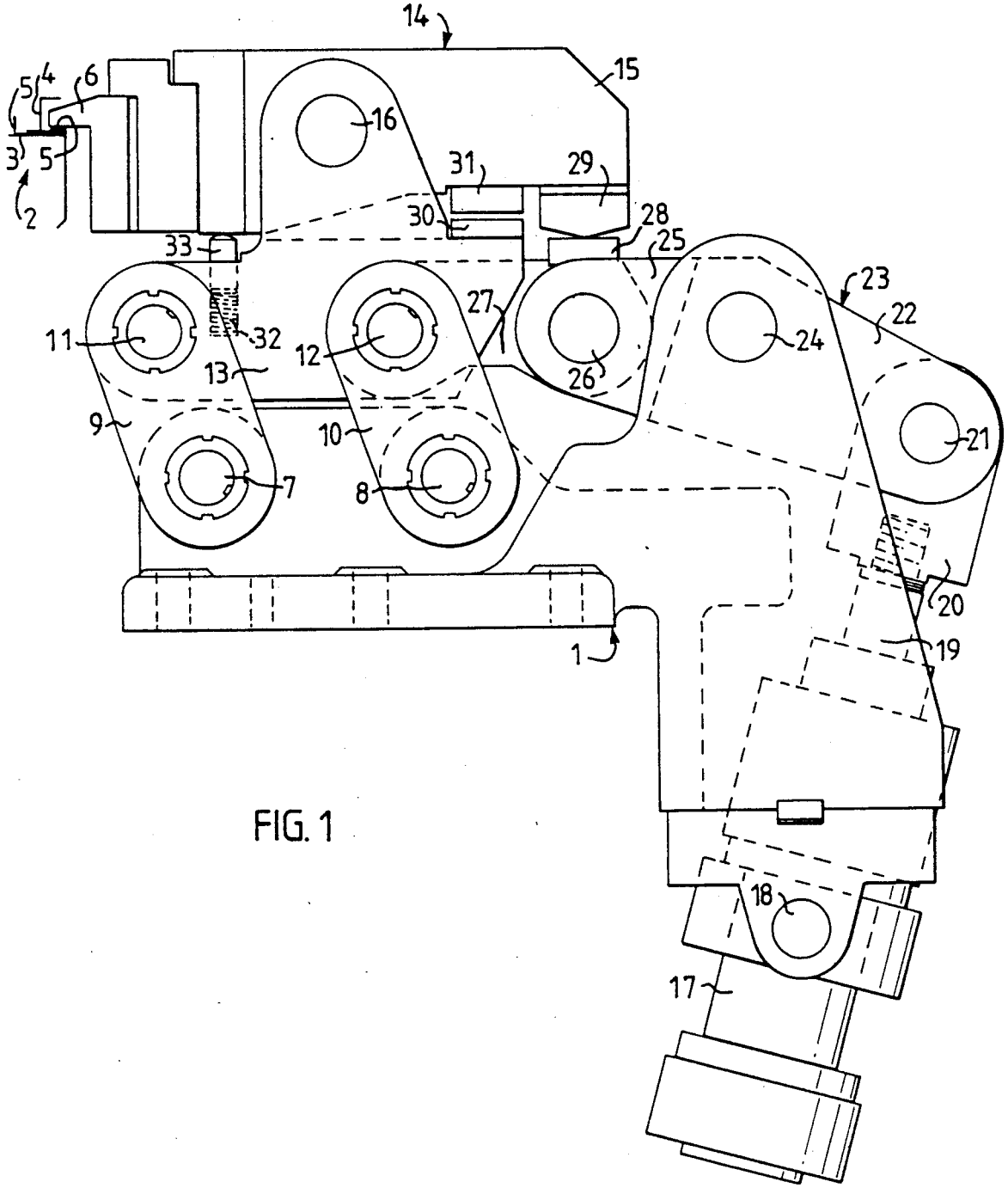

The apparatus illustrated in FIG. 1 comprises a stand 1 which is mounted on a support surface (not shown), which also supports a workpiece 2. The illustrated workpiece 2 comprises a sheet metal rail 3, in which a sheet metal profile section 4 is placed. The sheet metal rail 3 has two margin flanges 5, of which one flange is shown in FIG. 1 to be bent over a lower flange on the sheet profile section 4. Binding of the flange has been effected with the aid of a tool 6.

The stand 1 carries two journal pins 7 and 8 which are mutually parallel. Respective one ends of pivot arms 9 and 10 are journalled on a respective journal pin 7 and 8, and the other ends of the arms 9 and 10 are journalled on a respective journal pin 11 and 12. The journal pins 11 and 12 are carried by a main part 13 of a tool holder 14, which in addition to said main part 13 also includes a movable part 15, which is pivotally mounted on a journal pin 16 carried by the main part 13.

The spacing between the journal pins 7 and 8 is equal to the spacing between the journal pins 11 and 12, and the pivot arms 9 and 10 are of mutually equal lengths, and consequently the members 7–12 form a parallelogram mechanism. Consequently, the tool holder 14 can be moved relative to the stand 1, with the aid of the parallelogram mechanism 7–12. The movable part 15 of the tool holder 14 carries the tool 6, therewith enabling the tool 6 to be moved towards and away from the workpiece 2, when the tool holder 14 is moved with the aid of the parallelogram mechanism 7–12.

The stand 1 also carries a drive arrangement for effecting movement of the tool holder 14. This drive arrangement includes a pressure-medium operated piston-cylinder device 17, which is pivotally connected to the stand 1 by means of journal pins 18. The outer end of the piston rod 19 of the piston-cylinder device 17 is provided with an end piece 20, which is pivotally connected to one arm 22 of a double-arm lever 23, by means of a journal pin 21. The lever 23 is pivotally journalled on the stand 1 by means of a journal pin 24.

The free end of the other arm 25 of the double-arm lever 23 is pivotally connected, by means of a journal pin 26, to the one end of a link 27, the other end of which is journalled on the journal pin 12 of the parallelogram mechanism 7–12, between the stand 1 and the tool holder 14. The other arm 25 of the lever 23 and the link 27 therewith form a toggle linkage, which controls movement of the tool holder 14 in relation to the stand 1. In the position of the apparatus components illustrated in FIG. 1, the toggle linkage 25–27 is essentially fully extended. As will be seen from FIG. 1, a projection 28 on said other arm 25 of the lever 23 will therewith abut an abutment 29 on the movable part 15 of the tool holder 14. In this position of the apparatus components, contact between the projection 28 and the abutment 29 has caused the movable part 15 to pivot about the journal pin 16, such as to mutually separate two shoulders 30, 31 on the main part 13 and the movable part 15 respectively of said tool holder 14. This movement is effected against the action of a spring 32, which urges a pin 33 into abutment with the movable part 15 of the tool holder 14, such as to pivot the movable part 15 in a direction towards mutual contact of the shoulders 30 and 31.

Figure 2:
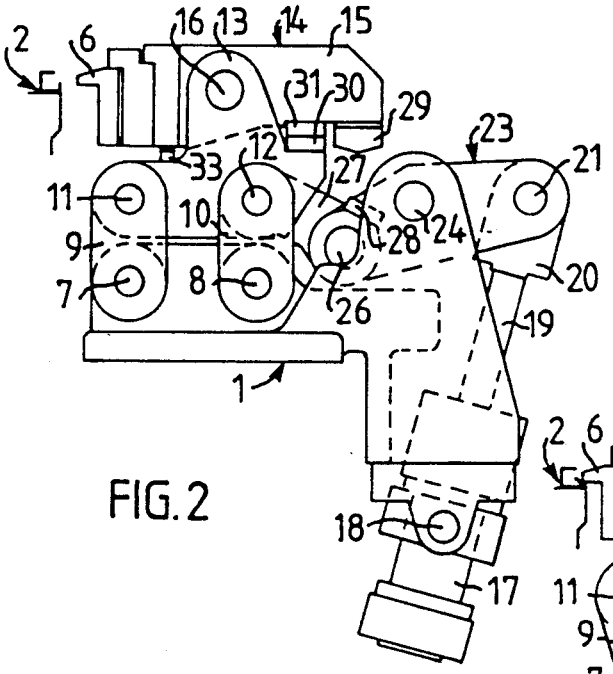
FIG. 2 is a schematic side view of the apparatus of FIG. 1, and shows the apparatus components in their respective starting positions, prior to commencing a working sequence.
Figure 3:
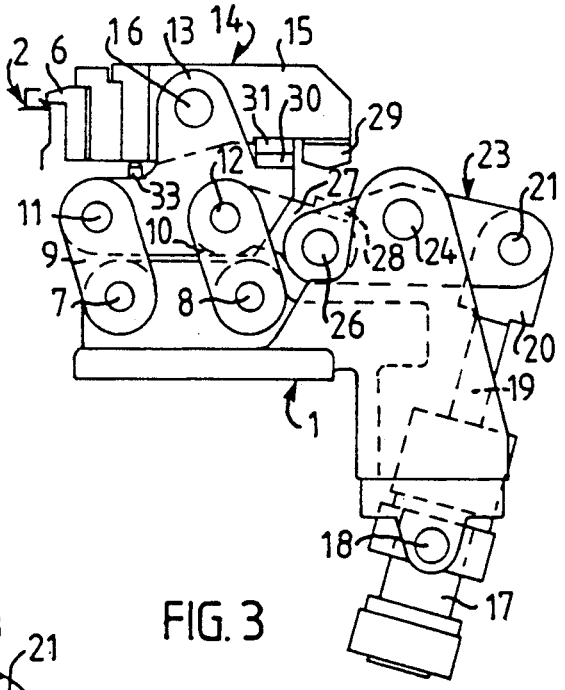
FIG. 3 is a schematic side view of the apparatus of FIG. 1, and shows the apparatus components in their respective preliminary bending or pre-form positions, during a working sequence.
Figure 4:
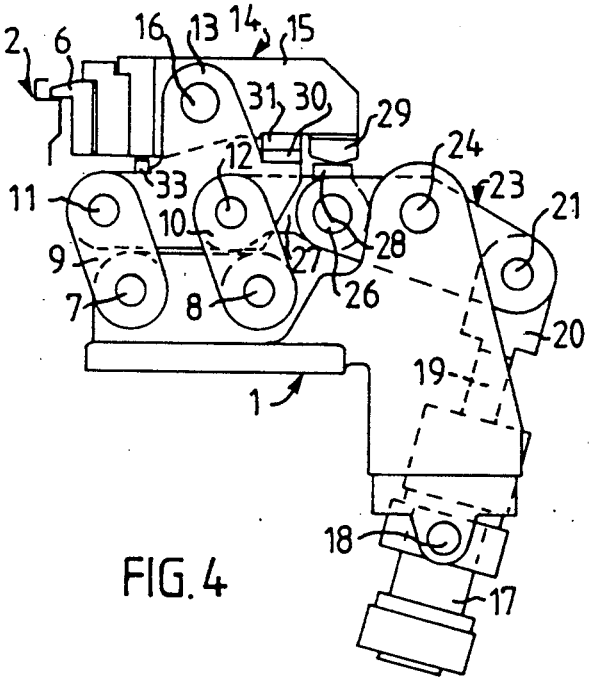
FIG. 4 is a schematic view of the apparatus of FIG. 1, and shows the apparatus components in their respective final bending or clinching positions during a working sequence.

FIGS. 2–4 illustrate schematically the different positions adopted by the apparatus components described with reference to FIG. 1 when carrying out a working sequence. FIG. 2 illustrates the apparatus components in their respective starting positions, in which the tool 6 is spaced from the workpiece 2. In this position, the piston rod 19 of the hydraulic piston-cylinder device 17 is fully extended, and consequently the lever 23 is rotated in an anti-clockwise direction around the journal pin 24 to the maximum possible extent. The toggle linkage 25–27 has therewith drawn the tool holder 14, by means of the parallelogram mechanism 7–12, as far to the right as possible, when seen in the drawing. The projection 28 is spaced from the abutment 29, and the pin 33, under the influence of the spring 32, has rotated the movable part 15 of the tool holder 14 as far as possible around the journal pin 16 in a clockwise direction, so that the shoulders 30 and 31 are in abutment with one another.

FIG. 3 illustrates the apparatus components in a position in which the tool 6 has bent the margin flange 5 of the workpiece 2 through an angle of about 45°. In order for the apparatus to have reached this operating position, the piston rod 19 has been withdrawn to a given extent into the cylinder of the piston-cylinder device 17, such as to rotate the lever 23 clockwise about the journal pin 24. In conjunction herewith, the journal pin 26 of the toggle linkage 25–27 has been moved upwards, as seen in the drawing, and, at the same time, the parallelogram mechanism 7–12 has moved the tool holder 14 to the left to an extent such that the tool 6 has come into engagement with the margin flange 5.

FIG. 4 illustrates the apparatus components in a position in which the projection 28 has just come into contact with the abutment 29. The piston rod 19 has, in this case, been withdrawn further into the cylinder of the piston-cylinder device 17, and has therewith caused the lever 23 to rotate further about the journal pin 24. The parallelogram mechanism 7–12 has therewith moved the tool holder 14 further to the left, as seen in the drawing, so that the tool 6 has substantially completely bent the margin flange 5. The shoulders 30, 31, however, are still in mutual abutment.

In order to effect final bending of the margin flange 5 to the position illustrated in FIG. 1, the piston rod 19 is withdrawn slightly from the position illustrated in FIG. 4. This will cause the lever 23 to pivot slightly about the journal pin 24, so that the projection 28, with the aid of the abutment 29, will pivot the movable part 15 of the tool holder 14 about the journal pin 16, so as to press the tool 6 harder against the margin flange 5, to complete bending of the flange.

Subsequent to carrying out the aforedescribed working sequence, the apparatus components are returned to the starting position illustrated in FIG. 2, by extending the piston rod 19 from the cylinder of the piston-cylinder device 17. The spring 32 and the pin 33 therewith swing the movable part 15 of the tool holder 14 to an extent such that the shoulders 30 and 31 will abut one another. The apparatus is then ready to carry out a new working sequence.

The invention is not restricted to the aforedescribed exemplifying embodiment thereof, since modifications can be made thereto within the scope of the following claims.

I claim:

1. In apparatus for bending a margin flange (5), which projects at an angle to a surface on a workpiece (2), against said workpiece, the apparatus including a bending tool (6) having a nose, said bending tool being mounted on a tool holder (14) carried by a parallelogram mechanism (7–12) for movement in relation to a stand (1) on which the workpiece (2) is placed, said parallelogram mechanism comprising links (9, 10) having each at one end a pivot axis (7, 8) carried by the stand (1) and at the other end a pivot axis (11, 12) carried by the tool holder (14), the distance between the stand-carried pivot axes (7, 8) being equal to the distance between the pivot axes (11, 12) carried by the tool holder (14) and the distance between the pivot axes (7, 11) on one link (9) being equal to the distance between the pivot axes (8, 12) on the other link (10), a drive arrangement (17) which is drivingly connected to the tool holder (14) by means of a linkage (21–27); the improvement wherein the tool holder (14) includes a main part (13) connected to the parallelogram mechanism (7–12) and a movable part (15) which is pivotal about a journal pin (16) on the main part, said journal pin (16) being substantially parallel with said axes (7, 8, 11, 12) of the parallelogram mechanism; the movable part (15) carries the tool (6) and by means of a resilient element (32) located on the main part is urged towards a starting position wherein the nose of the tool (6) is biased away from the stand holding the workpiece (2); said linkage including a projection (28) for co-action with an abutment (29) on the movable part (15) of the tool holder (14) whereby in one position of the linkage (21–27), the projection contacts the abutment to cause the movable part (15) of the tool holder (14) to move away from the starting position towards an end position wherein the tool is in engagement with the margin flange of the workpiece, the main part (13) of the tool holder (14), by way of the parallelogram mechanism, being moved into the vicinity of the end position of the tool holder (14).

2. Apparatus according to claim 1, characterized in that the drive arrangement comprises a pressure-medium operated piston-cylinder device (17), the cylinder of which is pivotally connected to the stand (1) and the piston-rod (19) of which is pivotally connected to the linkage (21–27).

* * * * *